US009132841B2

(12) United States Patent
Johnson

(10) Patent No.: US 9,132,841 B2
(45) Date of Patent: Sep. 15, 2015

(54) APPARATUS FOR MOVING RAILCARS VIA SELF-PROPULSION

(71) Applicant: Johnson Hydramotive, LLC, Cornelia, GA (US)

(72) Inventor: Chipley H. Johnson, Clarkesville, GA (US)

(73) Assignee: Johnson Hydramotive, LLC, Cornelia, GA (US)

( * ) Notice: Subject to any disclaimer, the term of this patent is extended or adjusted under 35 U.S.C. 154(b) by 32 days.

(21) Appl. No.: 13/782,887

(22) Filed: Mar. 1, 2013

(65) Prior Publication Data

US 2013/0239846 A1 Sep. 19, 2013

Related U.S. Application Data

(60) Provisional application No. 61/611,264, filed on Mar. 15, 2012.

(51) Int. Cl.
*B61C 7/00* (2006.01)
*B61C 9/00* (2006.01)

(52) U.S. Cl.
CPC .... *B61C 7/00* (2013.01); *B61C 9/00* (2013.01)

(58) Field of Classification Search
CPC ..... B61C 9/50; B61C 9/48; B61C 9/00; B61C 9/38; B61C 9/44; B61C 15/02; B61F 3/04
USPC ..... 105/54, 55, 96, 96.1, 133, 136, 140
See application file for complete search history.

(56) References Cited

U.S. PATENT DOCUMENTS

| | | | | | |
|---|---|---|---|---|---|
| 1,911,531 | A * | 5/1933 | Roderwald | ..... | 105/105 |
| 3,762,336 | A * | 10/1973 | Gooch | ..... | 105/136 |
| 4,170,945 | A * | 10/1979 | Kayserling | ..... | 105/133 |
| 4,867,072 | A * | 9/1989 | Kleim et al. | ..... | 105/133 |
| 5,345,878 | A | 9/1994 | Jacob | | |
| 6,343,554 | B1 * | 2/2002 | Affeldt et al. | ..... | 105/96 |
| 2013/0167753 | A1 * | 7/2013 | Kral et al. | ..... | 105/54 |

* cited by examiner

*Primary Examiner* — Mark Le

(57) ABSTRACT

An apparatus that can be affixed to a standard railcar thereby converting a standard railcar into a self-propelled railcar, such self-propelled railcar having the capacity to move independently and serve as a locomotive for moving other railcars. The apparatus includes a railcar drive assembly that can be retrofitted to a railcar in such a manner that the hydraulic motor, hoses, and connectors of the drive assembly motor mechanism are positioned below the bed of the railway car and between the drive assembly housing and the railway car's wheel-and-truck assembly. This drive assembly design ensures that the drive assembly motor mechanism's hydraulic motor, hoses, and connectors are protected from general railway track debris as well as obstructions in the railroad right of way, and helps prevent unnecessary damage or the need for untimely maintenance.

24 Claims, 9 Drawing Sheets

FIG. 1–(PRIOR ART)

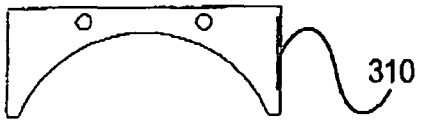
FIG. 6A
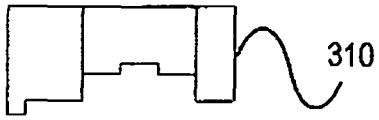
FIG. 6B
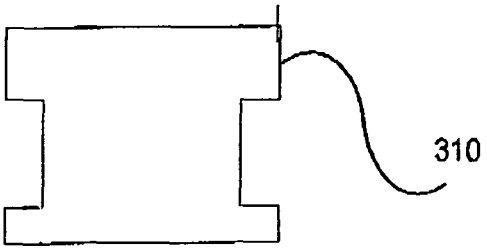
FIG. 6C
*FIG. 6*

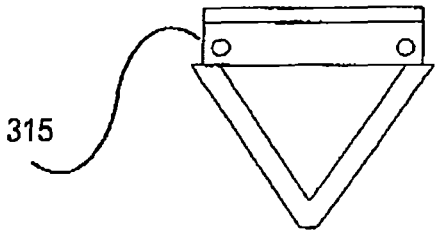
FIG. 7A
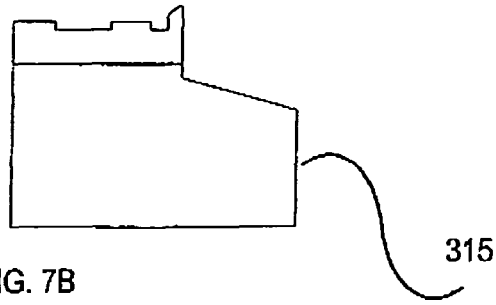
FIG. 7B
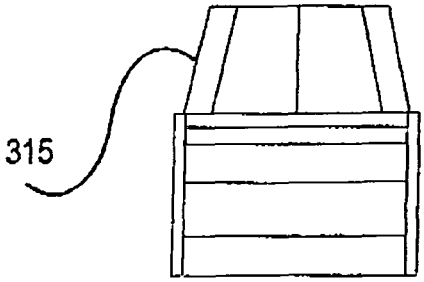
FIG. 7C
*FIG. 7*

APPARATUS FOR MOVING RAILCARS VIA SELF-PROPULSION

CROSS REFERENCE TO RELATED APPLICATION

This application claims benefit under 35 U.S.C. § 119(*e*) of U.S. Provisional Patent Application No. 61/611,264, filed Mar. 15, 2012, and entitled "Apparatus for Moving Railcars", which is hereby incorporated by reference as if set forth herein in its entirety.

TECHNICAL FIELD

The present disclosure relates generally to an apparatus for converting a standard railcar into a self-propelled railcar. More particularly, the present disclosure relates to a mountable apparatus that can be affixed or retrofitted to a standard railcar that will provide the power necessary to propel. the railcar, thereby converting the standard railcar into a self-propelled railcar having the capacity to move independently and serve as a locomotive for moving other railcars.

BACKGROUND

In various industrial situations there is a need for a convenient and economical means for moving railcars without attaching the railcars to a traditional locomotive, which then pushes or pulls the railcars to a desired location. Attaching railcars to a traditional locomotive is both inconvenient and time-consuming, and it may require more space than is available in a railroad yard. Additionally, moving a railcar by hand is not an effective solution as it requires substantial manpower and many man hours.

Railcars may also be used for track maintenance, construction, and various other tasks. Therefore, for these applications, the method of attaching railcars to a traditional locomotive is likewise inconvenient and expensive. For example, railcars may be fitted with an apparatus for clearing brush and small trees from a railroad's right of way. In such an instance, the brush clearing apparatus necessarily faces toward the front, and thus any external means of moving the railway car necessarily pushes the railway car from behind. This external means of pushing a railcar, however, is neither convenient nor efficient as an external means such as a traditional locomotive requires additional operational and maintenance costs. Further, to effectively clear brush from the right of way, the railcar fitted with the brush clearing apparatus would need to make more than one pass, and an external means for moving the railway car, such as a locomotive, can not easily and effectively change direction as would be necessary in such a situation.

Various devices have been proposed to address the problem of moving a railcar while allowing for relative ease in changing directions and without requiring an inordinate amount of space. For example, U.S. Pat. No. 5,345,878 describes a method and apparatus and method for moving railway cars using hydraulic motors, which are directly coupled coaxially to the outermost end of a railcar axle, as shown in FIG. 1. Such an arrangement exposes the hydraulic motors to trackside debris (e.g., plant and tree overgrowth, railroad equipment, signage, etc.) as well as other obstructions capable of damaging the motors. Therefore, such a configuration has certain drawbacks.

Others devices for moving a railcar without the use of a locomotive include U.S. Pat. No. 6,343,554, U.S. Pat. No. 3,762,336, U.S. Pat. No. 4,170,945, U.S. Pat. No. 4,867,072.

Each of these designs require modification to a railcar wheel and truck assembly. The design proposed here can be installed onto a railcar with no modification to the wheel and truck assembly.

Despite the proposed solutions, there remains a need for an apparatus that is easy to install and remove, is relatively small and inexpensive, and which is confined within the railway car's standard railcar width, thus protecting the apparatus from unnecessary exposure to trackside debris or various other obstructions that could damage the apparatus. Additionally, there remains a need for a device that can be easily retrofitted to a railcar (or standard railcar bogie), thus creating a self-propelled railcar that can operate as a locomotive, either moving independently or moving other railcars, while also being smaller, more mobile and significantly less expensive than a traditional locomotive.

BRIEF SUMMARY OF THE DISCLOSURE

Briefly described, and according to one embodiment, aspects of the present disclosure generally relate to a mountable apparatus that can be affixed to a standard railcar thereby converting a standard railcar into a self-propelled railcar, such self-propelled railcar having the capacity to move independently and serve as a locomotive for moving other railcars. Particularly, aspects of the present disclosure relate to a railcar drive assembly that can be retrofitted to a railcar in such a manner that the hydraulic motor, hoses, and connectors of the drive assembly motor mechanism are positioned below the bed of the railway car and between the drive assembly housing and the railway car's wheel-and-truck assembly. As will be understood and appreciated, this drive assembly design. ensures that the drive assembly motor mechanism's hydraulic motor, hoses, and connectors are protected from general railway track debris (e.g., plant and tree overgrowth, railroad equipment, signage, etc.) as well as obstructions in the railroad right of way, and helps prevent unnecessary damage or the need for untimely maintenance.

According to one embodiment, a single drive assembly comprises a pair of drive assembly motor mechanisms, each of which attaches to a railcar wheel-and-truck assembly (i.e., "bogie" or "truck"). As will be understood by those familiar with railcars, pairings of railcar wheel-and-truck assemblies ("bogies") are standard and commonplace. Further, according to one embodiment, each drive assembly motor mechanisms connects to a single railcar axle via an upper adapter and a lower adapter, which are seated directly to a journal bearing attached near the end of the truck assembly axle. Additionally, according to one embodiment, each pair of drive assembly motor mechanisms is interconnected via a single horizontal torsion link and a pair of diagonal torsion links, thus creating a single drive assembly.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same part and component descriptions are used throughout the drawings to refer to the same or like elements of an embodiment, and wherein:

FIGS. 6A-6C are views of an upper adapter according to one embodiment of the present disclosure.

FIGS. 7A-7C are views of a lower adapter according to one embodiment of the present disclosure.

DETAILED DESCRIPTION

Figure 1:
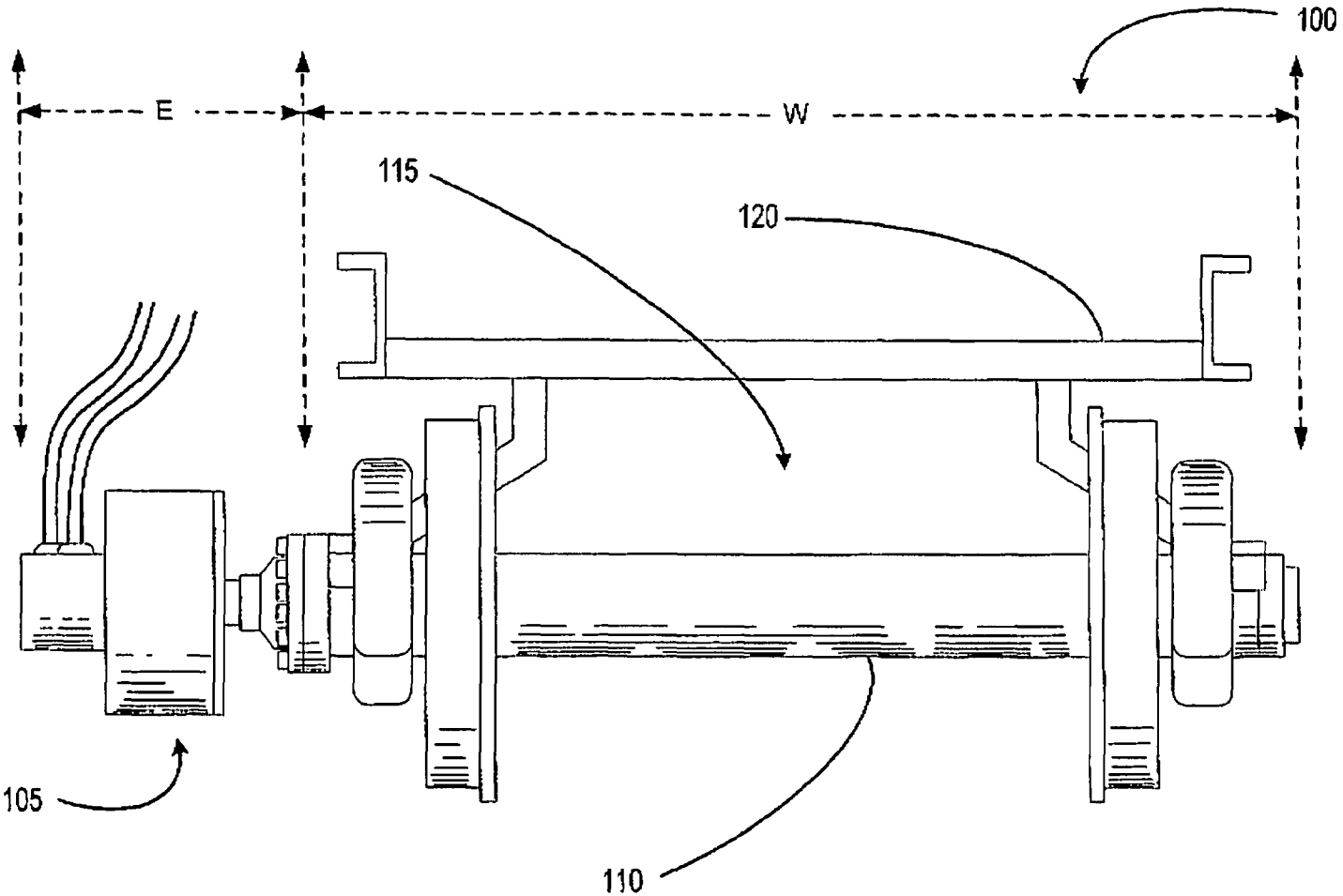
FIG. 1 is a view of a prior art railcar moving apparatus installed on a typical flatbed railcar as shown in U.S. Pat. No. 5,345,878.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein, are contemplated as would normally occur to one skilled in the art to which the disclosure relates. All limitations of scope should be determined in accordance with and as expressed in the claims.

Briefly described, and according to one embodiment, aspects of the present disclosure generally relate to an apparatus for converting a standard railcar into a self-propelled railcar, such self-propelled railcar having the capacity to move independently and serve as a locomotive for moving other railcars. Particularly, aspects of the present disclosure relate to a railcar drive assembly that can be retrofitted to a railcar in such a manner that the hydraulic motor, hoses, and connectors of the drive assembly motor mechanism are positioned below the bed of the railcar and between the drive assembly housing and the railcar's wheel-and-truck assembly. As will be understood and appreciated, this drive assembly design ensures that the drive assembly's hydraulic motor, hoses, and connectors are protected from general railroad right of way obstructions, and helps prevent unnecessary damage or the need for untimely maintenance.

According to one embodiment, a single drive assembly comprises a pair of drive assembly motor mechanisms, each of which attaches to a. railcar wheel-and-truck assembly. As will be understood by those familiar with railcars, pairings of railcar wheel-and-truck assemblies are standard and commonplace. Further, according to one embodiment, each drive assembly motor mechanisms connects to a single railcar axle via an upper adapter and a lower adapter, which are seated directly to a journal bearing attached near the end of the truck assembly axle. Additionally, according to one embodiment, each pair of drive assembly motor mechanisms is interconnected via a single horizontal torsion link and a pair of diagonal torsion links, thus creating a single drive assembly.

FIG. 1 shows an exemplary railcar moving apparatus 105, per U.S. Pat. No. 5,345,878, attached to the axle 110 of the truck assembly 115 attached to the bed 120 of a typical railcar 100. As will be understood by one skilled in the art, the railcar moving apparatus 105 is retrofitted to a conventional railcar wheel-and-truck assembly 115. Conventional railcar wheel-and-truck assemblies 115, the components that comprise them, and their functionality, none of which are claimed in this disclosure, are well known to those familiar with conventional railcars. Further, the prior art (e.g., U.S. Pat. No. 5,345,878) provides in-depth discussion of conventional railcar wheel-and-truck assemblies (i.e., bogies) and their functionality. When referring to a component of a conventional railcar wheel-and-truck assembly in this disclosure, effort will be made to use a component's generally-accepted name.

As discussed previously and as the one known approach shown in FIG. 1 illustrates, the railcar moving apparatus 105 of U.S. Pat. No. 5,345,878 extends beyond the standard railcar width (illustrated as W) of the railcar bed 120, thus exposing the railcar moving apparatus 105 to trackside debris and other obstructions in the railroad right of way capable of damaging the apparatus 105, which extends into an excess width (illustrated as E) beyond the standard railcar width. As will be discussed further in relation to FIG. 4, the presently-disclosed apparatus prevents such exposure.

Figure 2:
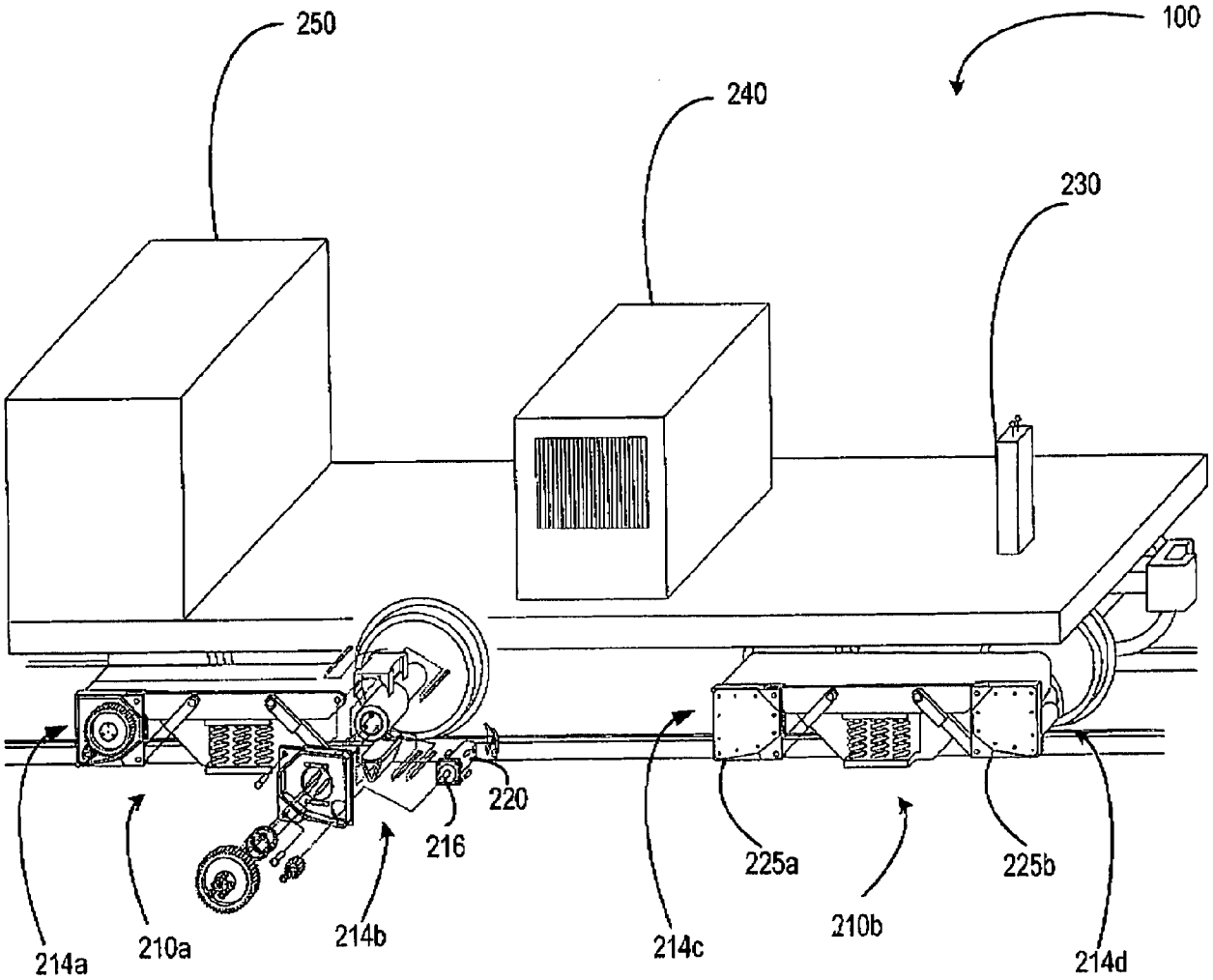
FIG. 2 is a perspective of a railcar outfitted with two railcar drive assemblies according to one embodiment of the present disclosure. One railcar drive assembly is shown fully assembled. The other railcar drive assembly is shown with one railcar drive assembly motor mechanism in exploded view.

FIG. 2 shows a perspective of a typical railcar 100 outfitted with exemplary embodiments of railcar drive assemblies 210*a* and 210*b* as described by the present disclosure. As is shown (and as will be discussed further herein), according to one embodiment, a single railcar drive assembly (e.g., 210*a* or 210*b*) comprises two drive assembly motor mechanisms (e.g., 214*a* and 214*b* or 214*c* and 214*d*). FIG. 2 shows an exploded view of a drive assembly motor mechanism 214*b*, which will be discussed in relation to FIG. 3. The right-side railcar drive assembly 210*b* is fully assembled and mounted to the railcar's wheel-and-truck assembly (bogie). As shown and according to one embodiment, a cover plate (e.g., 225*a* or 225*b*) encloses a fully-assembled drive assembly motor mechanism (e.g., 214*c* or 214*d*) to protect the internal components.

Additionally, the railcar shown in FIG. 2 is outfitted with operator controls 230. According to one embodiment, operator controls 230 allow an operator to control the railcar drive assembly hydraulic motors 220. As will be understood by one familiar with hydraulic motors, according to one embodiment, operator controls 230 allow an operator to change the rotational direction of the hydraulic motor drive shaft 216. As will be understood by one of ordinary skill, by changing the rotational. direction of the hydraulic motor drive shaft 216, an operator is able to change the rotational direction of the axle 110 of the truck assembly 115, thus changing the linear direction of the railcar 100. Further, as will be understood by one of ordinary skill in the art, operator controls 230 may be used to control a plurality of drive assemblies (e.g., 210*a* and 210*b*) retrofitted to a single railcar 100.

Further, the railcar in FIG. 2 is outfitted with a hydraulic power unit 240. According to one embodiment, the hydraulic power unit 240 comprises hydraulic pumps (not shown) that are operatively connected to the railcar drive assembly hydraulic motor 220. As will be understood by one of ordinary skill in the art, a hydraulic power unit 240 may be operatively connected to a plurality of drive assembly hydraulic motors (e.g., 220). Finally, the railcar in FIG. 2 is outfitted with a ballast weight 250 that matches the tractive effort available from the railcar drive assemblies 210*a* and 210*b* at 25% wheel-to-rail adhesion.

Figure 3:
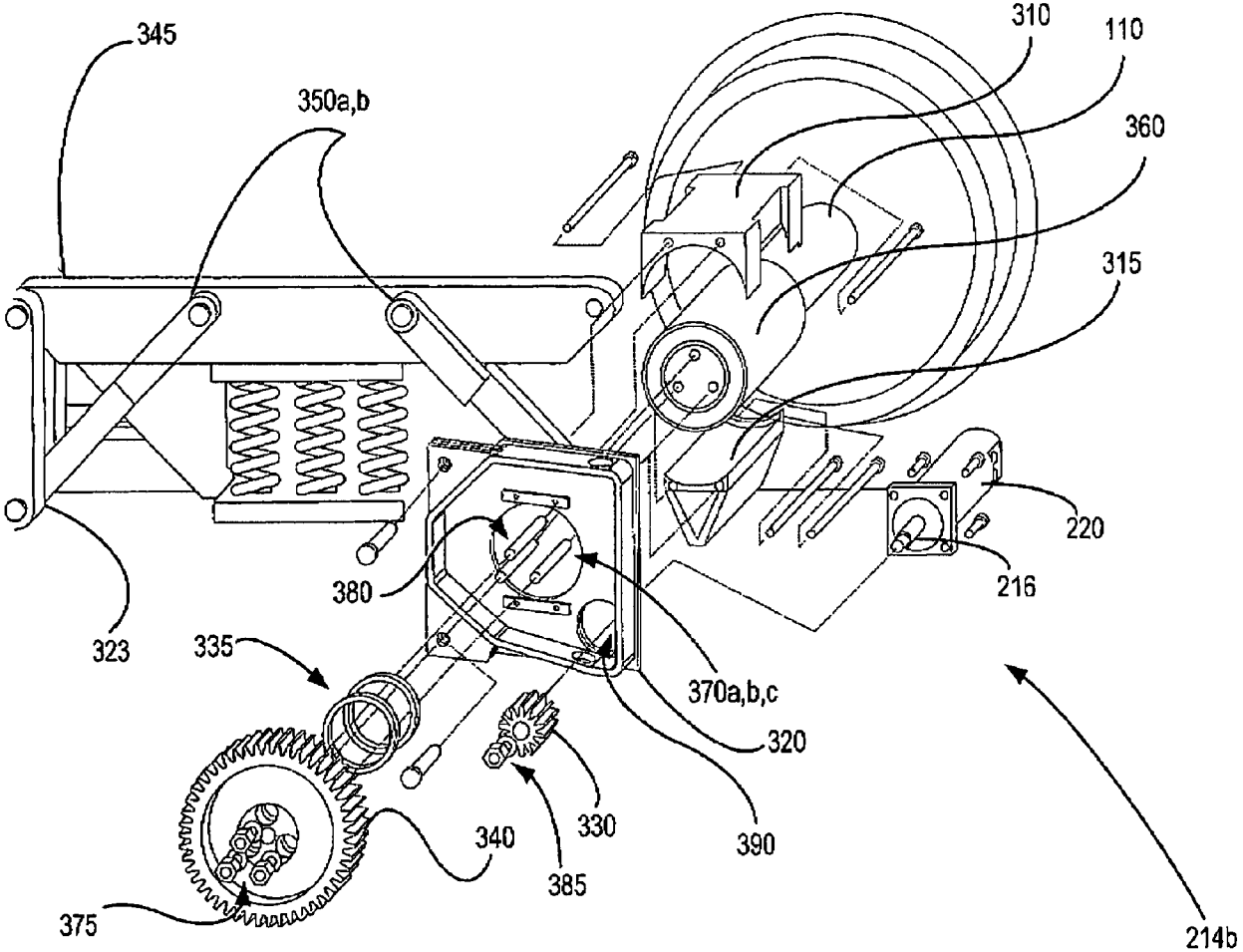
FIG. 3 is a rear view of a railcar drive assembly motor mechanism illustrating that the railcar drive assembly motor mechanism's hydraulic motor, hoses, and connectors are positioned below the bed of the railcar and between the drive assembly housing and the railcar's wheel-and-truck assembly according to one embodiment of the present disclosure.

FIG. 3 is an exploded railcar drive assembly 210 displayed in FIG. 2, which explicitly details the components of a single exemplary drive assembly motor mechanism 214*b*. According to one embodiment, a single railcar drive assembly motor mechanism 214*b* comprises the following: upper adapter 310 and lower adapter 315; drive assembly motor mechanism housing 320 with motor mount (321, not shown; see FIG. 5B); hydraulic motor 220 with necessary hoses and connectors (not shown) and hydraulic motor drive shaft 216; motor gear 330; bearing retainer and lock 335; axle gear 340; drive assembly motor mechanism housing cover plate (not shown); and various connecting hardware as is necessary (not shown). Further, according to one embodiment, the independent drive assembly motor mechanisms (e.g., 214*a*, 214*b*) comprising a single railcar drive assembly (e.g., 210*a*) are connected using a horizontal torsion link 345 and a pair of diagonal torsion links 350*a* and 350*b*.

As will be understood by those familiar with conventional bogies or railcar wheel-and-truck assemblies 115, in a typical configuration, a journal bearing 360 is attached near the end of the truck assembly axle 110. According to one embodiment, a single drive assembly motor mechanism 214*b* connects to the axle 110 of a truck assembly 115 via an upper adapter 310 and lower adapter 315. According to one embodiment, the upper adapter 310 and lower adapter 315 are seated directly to the journal bearing 360 attached to the truck assembly axle 110. Typically, once they are seated to the journal bearing, the upper adapter 310 and lower adapter 315 connect directly to the motor mechanism housing 320 via a fastening or connecting means. According to one embodiment, this fastening or connecting means is by conventional threaded bolts. FIGS. 6 and 7 further illustrate the upper adapter 310 and lower adapter 315.

Additionally, according to one embodiment and as shown in FIG. 3, the axle gear 340 is secured to the axle 110 of a truck assembly 115 via fastening or connecting means (e.g., double-threaded studs 370*a, b, c*) that attaches directly to the end of the axle 110 and extends through the center hole 380 of the motor mechanism housing 320, through bearing retainer and lock 335, and through the axle gear 340, where it is secured in place. According to one embodiment, and as is shown in FIG. 3, three double-threaded studs 370 arranged in a triangular pattern and threaded into existing axle holes are utilized as the fastening means, and they are secured in place by conventional nuts and washers 375.

Figure 4:
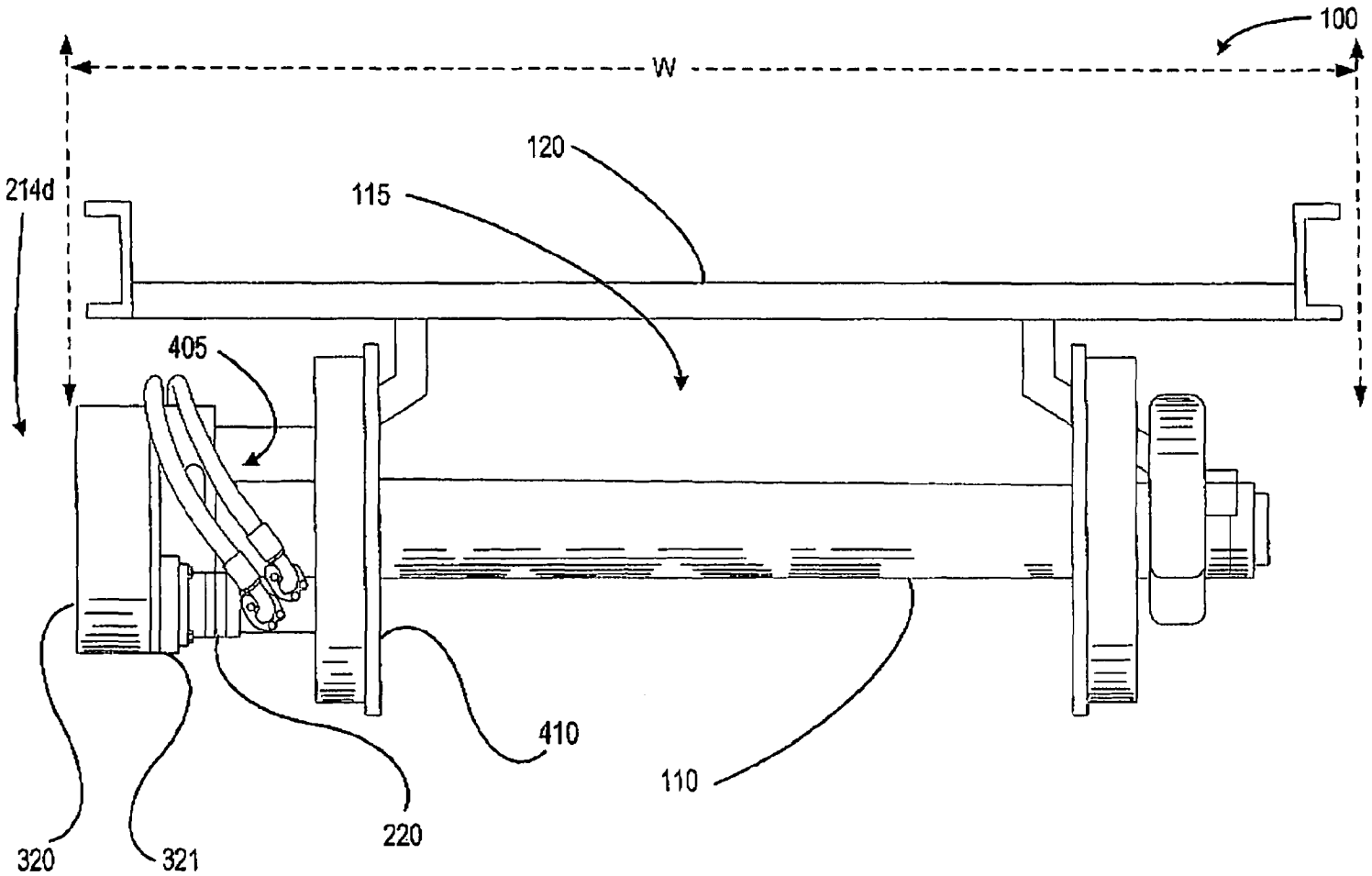
FIG. 4 is an exploded view of a railcar drive assembly that details the components comprising a single railcar drive assembly motor mechanism according to one embodiment of the present disclosure.

Still referring to FIGS. 3 and 4, according to one embodiment as described by the present disclosure, a drive assembly motor mechanism 214*b* preferably comprises a single hydraulic motor 220 adapted for attachment to the motor mount (321, not shown; see FIG. 5B) of a motor mechanism housing 320. According to one embodiment, hydraulic connectors connect hydraulic hoses 405 to the hydraulic motor 220, and the hydraulic hoses 405 are routed to an external mechanism for actuating the motor, as will be understood by one skilled in the art. According to one embodiment, the hydraulic hoses 405 are attached to a hydraulic power unit 240.

According to one embodiment and as shown in FIG. 3, the hydraulic motor drive shaft 216 extends into the interior of the motor mechanism housing 320 through the motor shaft hole 390, and a motor gear 330 attaches to the motor drive shaft 216 via a fastening means (e.g., conventional nut and washer 385). Generally, and according to one embodiment, the bearing retainer and lock 335 are threaded onto the hub of the axle gear 340 to provide axle bearing 360 retention. According to an alternate embodiment, the axle gear 340 can be permanently affixed to the end of the axle 110, e.g., by press-fitting, etc. It will be appreciated and understood that the hydraulic motor drive shaft 216, motor gear 330, and axle gear 340 are all interconnected such that when the hydraulic motor 220 actuates the motor drive shaft 216, rotational force is transferred from the motor drive shaft 216 to the motor gear 330, and then from the motor gear 330 to the axle gear 340, which then transfers the rotational force to the axle 110 of the railcar truck assembly 115. As will be understood by one of ordinary skill in the art and as discussed previously, this rotational force rotates the axle 110 of the railcar truck assembly 115, which in turn causes the railcar 100 to move linearly along a conventional railroad track.

As discussed previously, a need exists for a railcar moving apparatus that is configured such that the apparatus is confined within a standard railcar width, thus protecting the apparatus from unnecessary exposure to various railroad right of way obstructions that could damage the apparatus. As shown in FIG. 4, the railcar drive assembly motor mechanism 214*d* is positioned and configured such that the entire apparatus fits within standard railcar 100 width. Specifically, and in contrast to the prior art, the hydraulic motor 220 attaches to the motor mount 321 on the rear of the motor mechanism housing 320, according to the embodiment shown in FIG. 4. As will be understood and appreciated, this configuration protects the drive assembly motor mechanism 214*d*, and in particular protects the hydraulic motor 220 as well as the hydraulic connectors and hoses 405, as they are positioned between the railcar wheel 410 and the motor mechanism housing 320. Therefore, because the drive assembly motor mechanism 214*d* is supported for operation in the space below the railcar 100 and inside the outer limit of the standard railcar width, unlike other known approaches, the disclosed apparatus is not at risk of colliding with an obstacle in the railroad right of way.

According to the preferred embodiment and as described previously, a hydraulic motor 220 is used to actuate the motor gear 330, which in turn actuates the axle gear 340 and the axle 110 of the truck assembly 115. As will be understood and appreciated, hydraulic motors are compact and cost-efficient, and they are easily powered via a hydraulic power unit 240 located elsewhere on the railcar 100. According to one embodiment, a hydraulic power unit 240 is connected to the hydraulic motor 220 via hydraulic connectors and hoses 405, as will be understood by one skilled in the art. While the preferred embodiment of the apparatus utilizes a hydraulic motor 220, other means of actuating the motor gear 330 and axle gear 340 may be utilized.

Figure 5:
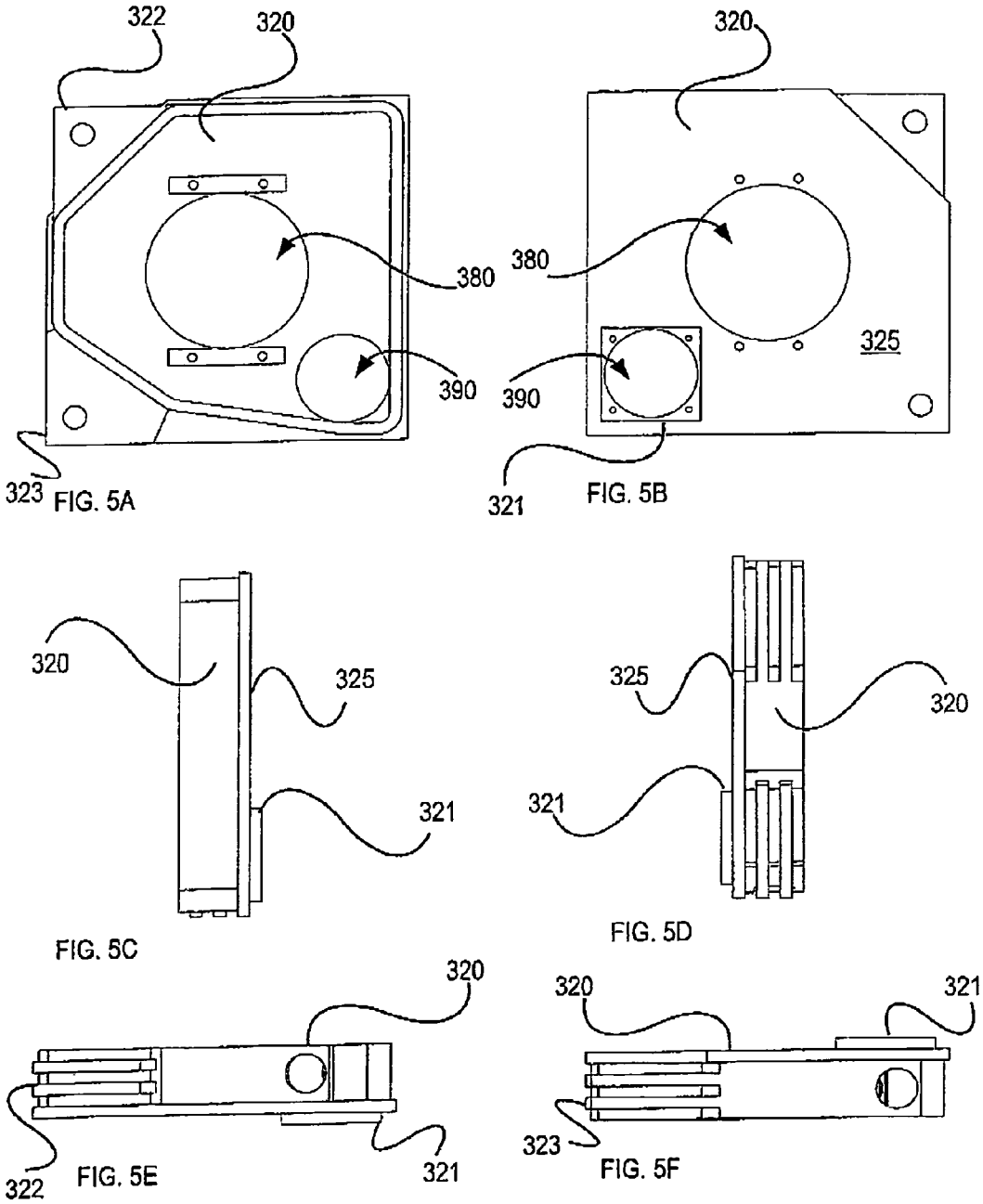
FIGS. 5A-5F are views of a drive assembly motor mechanism housing according to one embodiment of the present disclosure.

FIGS. 5A-5F are views of a drive assembly motor mechanism housing 320. According to one embodiment and as discussed previously, the motor mechanism housing comprises a motor mount 321, which is affixed (e.g., welded, etc.) to the back side 325 of the motor mechanism housing 320 as detailed in, for example, FIGS. 5B and 5C. Additionally, according to one embodiment, the motor mechanism housing 320 further comprises an upper torsion link mounting clevis 322 and a lower torsion link mounting clevis 323, as will be discussed further in relation to FIGS. 7 and 8 and as are detailed in, for example, the FIG. 5A. Further, as discussed previously and according to one embodiment, the motor mechanism housing 320 comprises a center hole 380 and motor shaft hole 390. The embodiment of the motor mechanism housing 320 shown in FIGS. 5A-5F is a right-side assembly, i.e., as viewed from a front plan view, the motor mount 321 is located in the bottom right corner, and the torsion link mounting plates 322 and 323 are located on the left side (as shown in FIG. 5A). As will be understood, a left-side assembly would encompass a mirror image of the embodiment shown in FIGS. 5A-5F, i.e., the motor mount 321 would be located in the bottom left corner, and the torsion link mounting plates 322 and 323 would be located on the right side (as viewed from a front plan view). As discussed in relation to FIG. 2, an exemplary railcar drive assembly (e.g., 210*b*) comprises two drive assembly motor mechanisms (e.g., 214*c* and 214*d*). According to one embodiment and as shown in FIG. 2, the interconnected pair of drive assembly motor mechanisms (e.g., 214*c* and 214*d*) comprising an exemplary railcar drive assembly 210*b* will comprise one right-side assembly motor mechanism. housing (e.g., 320) and one left-side motor mechanism housing (not shown).

FIGS. 6A-6C are views of an embodiment of an upper adapter 310. Likewise, FIGS. 7A-7C are views of an embodiment of a lower adapter 315. As discussed in relation to FIG. 3, a single drive assembly motor mechanism (e.g., 214*b*) connects to the axle 110 of a truck assembly 115 via an upper adapter 310 and lower adapter 315, which are seated directly to a journal bearing 360 attached to the truck assembly axle 110. As discussed, the upper adapter 310 and lower adapter 315 typically connect directly to the motor mechanism housing 320 via a fastening or connecting means. According to one embodiment, this fastening or connecting means is by conventional threaded bolts.

Figure 8:
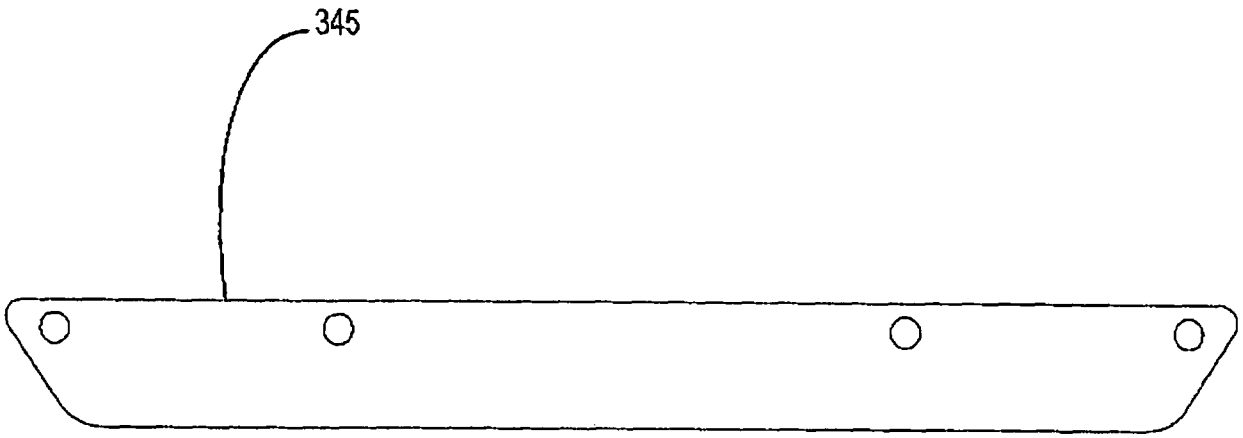
FIG. 8 is a front plan view of a horizontal strut according to one embodiment of the present disclosure.
Figure 9:
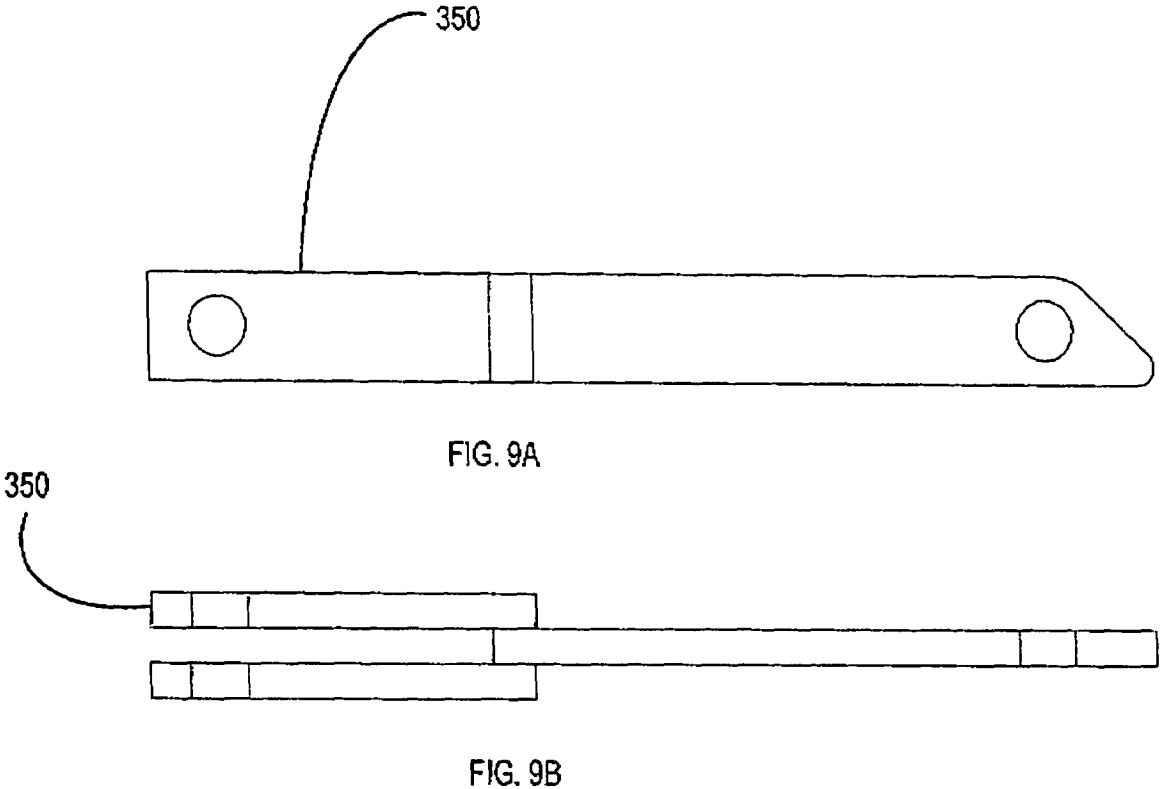
FIGS. 9A-9B are views of a diagonal strut according to one embodiment of the present disclosure.

FIGS. 8 and 9 are views of exemplary embodiments of a horizontal torsion link 345 and a diagonal torsion link 350, respectively. According to one embodiment, in an exemplary, fully-assembled railcar drive assembly (e.g., 210*a* or 210*b*), the left end of a horizontal torsion link 345 is pinned to the upper torsion link mounting clevis 322 of a left-side motor mechanism housing. Conversely, the right end of a horizontal torsion link 345 is pinned to the upper torsion link mounting clevis 322 of a right-side motor mechanism housing 320.

Additionally, according to one embodiment, in an exemplary, fully-assembled railcar drive assembly (e.g., 210*a* or 210*b*), a diagonal torsion link (e.g., 350*a*) is connected between a lower torsion mounting clevis 323 and a horizontal torsion link 345, as shown in FIG. 3. As will be understood and appreciated, a diagonal torsion link (e.g., 350) counteracts drive torque and keeps the drive assembly motor mechanisms (e.g., 214*a* and 214*b*) comprising a single drive assembly (e.g., 210*a*) properly aligned.

The foregoing description of the exemplary embodiment has been presented only for the purposes of illustration and description and is not intended to be exhaustive or to limit the apparatus to the precise forms disclosed. Many modifications and variations are possible in light of the above teaching.

What is claimed is:

1. A rail car moving apparatus detachably mountable to a railcar wheel-and-truck assembly, said wheel-and-truck assembly comprising a plurality of railcar wheels, said wheels having inward-facing surfaces facing each other and outwardly facing surfaces facing journal bearings, and a pair of wheel-and-truck assembly axles, said railcar moving apparatus comprising:

a railcar drive assembly, said railcar drive assembly comprising two drive assembly motor mechanisms, each said drive assembly motor mechanism comprising:

a motor mechanism housing having an outward-facing surface and an inward-facing surface, the motor mechanism housing provided at a side such that the motor mechanism housing inward-facing surface faces outward-facing surfaces of upper and lower adapters, said motor mechanism housing comprising:

a motor mount affixed to the inward-facing surface of the motor mechanism housing, the motor mount configured to support a hydraulic motor;

a hydraulic motor affixed to said motor mount and positioned such that the motor mechanism housing faces an outside surface of the motor mount, said hydraulic motor configured to provide a rotational drive force, said hydraulic motor comprising a hydraulic motor drive shaft, said hydraulic motor drive shaft having an axis of rotation parallel to and spaced apart from the axis of rotation of one of the wheel-and-truck assembly axles, said hydraulic motor drive shaft extending in the direction of, and spaced apart from the axle;

a first gear configured for receiving the rotational drive force from the hydraulic motor drive shaft, said first gear provided at a side facing the outward-facing surface of the motor mechanism housing and positioned in a plane that is normal to the axis of rotation of the wheel-and-truck assembly axle;

a second gear affixed to the wheel-and-truck assembly axle, said second gear configured for receiving the rotational drive force from the first gear, said second gear configured for transmitting said rotational drive force to the wheel-and-truck assembly axle, said second gear positioned in a plane that is normal to the axis of rotation of the wheel-and-truck assembly axle; and said upper adapter and lower adapter detachably mounted to an end of the wheel-and-truck axle for securing the railcar drive assembly to the wheel-and-truck assembly;

whereby when the rotational drive force is transferred from the hydraulic motor drive shaft to the wheel-and-truck assembly axle via the first and second gears, the rotational drive force rotates the wheel-and-truck assembly axle, which in turn moves the railcar linearly along a railroad track.

2. The apparatus of claim 1, wherein the railcar wheel-and-truck assembly is affixed to a railcar.

3. The apparatus of claim 1, further comprising a hydraulic power unit operatively connected to the hydraulic motor.

4. The apparatus of claim 3, further comprising operator controls operatively connected to the hydraulic power unit for controlling the direction of rotation of the hydraulic motor drive shaft.

5. The apparatus of claim 1, wherein the railcar drive assembly comprises a first and a second drive assembly motor mechanism.

6. The apparatus of claim 5, wherein the first and the second drive assembly motor mechanisms are interconnected via a horizontal torsion link.

7. The apparatus of claim 6, wherein a first diagonal torsion link is affixed to the first drive assembly motor mechanism and a second diagonal torsion link is affixed to the second drive assembly motor mechanism, said first and second diagonal torsion links further affixed to the horizontal torsion link.

8. The apparatus of claim 5, further comprising a hydraulic power unit operatively connected to the hydraulic motors of the first and the second drive assembly motor mechanisms.

9. The apparatus of claim 8, further comprising operator controls operatively connected to the hydraulic motors of the first and the second drive assembly motor mechanisms and the hydraulic power unit and for controlling the direction of rotation of the hydraulic motor drive shafts.

10. The apparatus of claim 1, further comprising a ballast weight for preventing the railcar wheels from slipping when the hydraulic motor is engaged.

11. A railcar moving apparatus detachably mountable to a railcar wheel-and-truck assembly, said wheel-and-truck assembly comprising a plurality of rail car wheels, said wheels having outward-facing surfaces and inward-facing surfaces, a pair of wheel-and-truck assembly axles, and a pair of side frames, said side frames positioned perpendicular to and apart from said wheel-and-truck assembly axles, said railcar moving apparatus comprising:

a railcar drive assembly, said railcar drive assembly comprising:

a first and a second drive assembly motor mechanism detachably mounted to a wheel and-truck assembly, each said drive assembly motor mechanism comprising:

a motor mechanism housing, the motor mechanism housing having an outward-facing surface and an inward-facing-surface, the motor mechanism housing provided at a side such that the motor mechanism housing inward-facing surface faces outward-facing surfaces of upper and lower adapters, said motor mechanism housing comprising:

a motor mount affixed to the inward-facing surface of the motor mechanism housing, the motor mount configured to support a hydraulic motor;

a hydraulic motor affixed to said motor mount and positioned such that the motor mechanism housing faces an outside surface of the motor mount, said hydraulic motor configured to provide a rotational drive force, said hydraulic motor comprising a hydraulic motor drive shaft, said hydraulic motor drive shaft having an axis of rotation parallel to and spaced apart front the axis of rotation of one of the wheel-and-truck assembly axles, said hydraulic motor drive shaft extending in the direction of and spaced apart from the axle;

a first gear configured for receiving the rotational drive force from the hydraulic motor drive shaft, said first gear provided at a side facing the outward-facing surface of the motor mechanism housing and positioned in a plane that is normal to the axis of rotation of the wheel-and-truck assembly axle;

a second gear affixed to the wheel-and-truck assembly axle, said second gear configured for receiving the rotational drive force from the first gear, said second gear configured for transmitting said rotational drive force to the wheel-and-truck assembly axle, said second gear positioned in a plane that is normal to the axis of rotation of the wheel-and-truck-assembly axle; and said upper adapter and lower adapter detachably mounted to an end of the wheel-and-truck assembly axle for securing the railcar drive assembly motor mechanism to the wheel-and-truck assembly;

a horizontal torsion link aligned in a direction parallel to and spaced apart from one of said side frames, said horizontal torsion link configured for connecting to and interconnecting the first and second drive assembly motor mechanisms; and a first and a second diagonal torsion link, each diagonal torsion link configured for further interconnecting the horizontal torsion link to first and second drive assembly motor mechanisms;

whereby when the rotational drive force is transferred from the hydraulic motor drive shaft to the wheel-and-truck assembly axle via the first and second gears, the rotational drive force rotates the wheel-and-truck assembly axle, which in tum moves the railcar linearly along a railroad track, and whereby the horizontal torsion link and the first and second diagonal torsion links maintain the proper alignment of the first and second drive assembly motor mechanisms.

12. The apparatus of claim 11, wherein the railcar wheel-and-truck assembly is affixed to a railcar.

13. The apparatus of claim 11, further comprising a hydraulic power unit operatively connected to the hydraulic motors of the first and second drive assembly motor mechanisms.

14. The apparatus of claim 13, further comprising operator controls operatively connected to the hydraulic power unit and for controlling the direction of rotation of the hydraulic motor drive shafts.

15. The apparatus of claim 11, further comprising a ballast weight for preventing the railcar wheels from slipping when the hydraulic motors are engaged.

16. A railcar moving apparatus detachably mountable to a railcar wheel-and-truck assembly, said wheel-and-truck assembly comprising a plurality of railcar wheels, said wheels having outward-facing surfaces and inward-facing surfaces, and a plurality of wheel-and-truck assembly axles, said rail car having a railcar width, wherein the railcar includes a first side and a second side with said railcar width disposed there between, said railcar moving apparatus comprising:

a railcar drive assembly, said railcar drive assembly comprising:

two drive assembly motor mechanisms detachably mounted to a wheel-and-truck assembly; each said drive assembly motor mechanism comprising:

an upper adapter and a lower adapter detachably mounted to one of said wheel-and-truck assembly axles for securing the drive assembly motor mechanism to the wheel-and-truck assembly;

a motor mechanism housing having an outward-facing surface and an inward-facing surface, the motor mechanism housing provided at a side such that the motor mechanism housing inward-facing surface faces outward-facing surfaces of said upper and lower adapters, said motor mechanism housing comprising:

a motor mount affixed to the inward-facing surface of the motor mechanism housing, the motor mount configured to support a hydraulic motor;

a hydraulic motor comprising a hydraulic motor drive shaft, said hydraulic motor affixed to the motor mount and configured to provide a rotational drive force via a hydraulic motor drive shaft, said hydraulic motor drive shaft having an axis of rotation parallel to and spaced apart from the axis of rotation of one of the wheel-and-truck assembly axles, said hydraulic motor drive shaft extending in the direction of and spaced apart from the axle, wherein the hydraulic motor is positioned within the railcar width and is thereby protected from exposure to obstructions in the railroad right of way;

a first gear configured for receiving the rotational drive force from the hydraulic motor drive shaft, said first gear positioned in a plane that is normal to the axis of rotation of the wheel-and-truck assembly axle; and a second gear affixed to the wheel-and-truck assembly axle, said second gear configured for receiving the rotational drive force from the first gear, said second gear configured for transmitting said rotational drive force to the wheel-and-truck assembly axle, said second gear positioned in a plane that is normal to the axis of rotation of the wheel-and-truck assembly axle;

whereby when the rotational drive force is transferred from the hydraulic motor drive shaft to the wheel-and-truck assembly axle via the first and second gears, the rotational drive force rotates the wheel-and-truck assembly axle, which in turn moves the railcar linearly along a railroad track, and whereby the railcar moving apparatus does not extend outside the railcar width into the railroad right of way.

17. The apparatus of claim 1, further comprising a hydraulic power unit operatively connected to the hydraulic motor.

18. The apparatus of claim 17, further comprising operator controls operatively connected to the hydraulic power unit for controlling the direction of rotation of the hydraulic motor drive shaft.

19. The apparatus of claim 16, wherein the railcar drive assembly comprises a first and a second drive assembly motor mechanism.

20. The apparatus of claim 19, wherein the first and the second drive assembly motor mechanisms are interconnected via a horizontal torsion link.

21. The apparatus of claim 20, wherein a first diagonal torsion link is affixed to the first drive assembly motor mechanism and a second diagonal torsion link is affixed to the second drive assembly motor mechanism, said first and second diagonal torsion links further affixed to the horizontal torsion link.

22. The apparatus of claim 19, further comprising a hydraulic power unit operatively connected to the hydraulic motors of the first and the second drive assembly motor mechanisms.

23. The apparatus of claim 22, further comprising operator controls operatively. connected to the hydraulic motors of the first and the second drive assembly motor mechanisms and the hydraulic power unit and for controlling the direction of rotation of the hydraulic motor drive shafts.

24. The apparatus of claim 16, further comprising a ballast weight for preventing the railcar wheels from slipping when the hydraulic motor is engaged.

* * * * *